United States Patent [19]

Donley et al.

[11] 4,090,522

[45] May 23, 1978

[54] MEDICATED COMB FOR DANDRUFF AND OTHER HAIR AND SCALP DISEASES

[76] Inventors: Virgil L. Donley, c/o George Spector, 3615 Woolworth Bldg., 233 Broadway; George Spector, 3615 Woolworth Bldg., 233 Broadway, both of, New York, N.Y. 10007

[21] Appl. No.: 649,134

[22] Filed: Jan. 14, 1976

[51] Int. Cl.[2] ..... A45D 24/22

[52] U.S. Cl. ..... 132/112

[58] Field of Search ..... 222/192, 213; 132/112–115

[56] References Cited

U.S. PATENT DOCUMENTS

| | | | |
|---|---|---|---|
| 727,312 | 5/1903 | Douglas | 132/112 |
| 1,005,412 | 10/1911 | Charles | 132/112 |
| 2,397,321 | 3/1946 | Leach | 222/213 X |
| 2,465,014 | 3/1949 | Feiner | 132/112 |
| 3,011,499 | 12/1961 | Tajan | 132/112 X |
| 3,147,757 | 9/1964 | Hoffmann | 132/114 |

*Primary Examiner*—Joseph F. Peters, Jr.
*Assistant Examiner*—Norman L. Stack, Jr.

[57] ABSTRACT

A comb for applying medication to the hair and scalp; the comb being hollow so to contain the medication, and the comb teeth each having a central opening extending to the tooth tip so that as the comb is combed through the hair, the medication is dispensed out of the tip of the teeth and massaged into the scalp.

2 Claims, 6 Drawing Figures

MEDICATED COMB FOR DANDRUFF AND OTHER HAIR AND SCALP DISEASES

This invention relates generally to medication applying devices. More specifically it relates to combs.

A principle object of the present invention is to provide a comb that is used for applying medication to a scalp and hair so to cure dandruff, mange or other diseases of the scalp and hair.

Another object is to provide a comb that serves both as a container for storing the medication therewithin and also as a dispensing applicator, so that it can be conviently carried by a person in a purse or pocket in order to be always handy whenever a treatment is desired.

Still another object is to provide a medicated comb which is adjustable so that it can be used for combing the hair without applying medication whenever so wished.

Other objects are to provide a medicated comb which is simple in design, inexpensive to manufacture, rugged in construction, easy to use and efficient in operation.

These and other objects will be readily apparent upon a study of the following specification and the accompanying drawing wherein.

Figure 5:
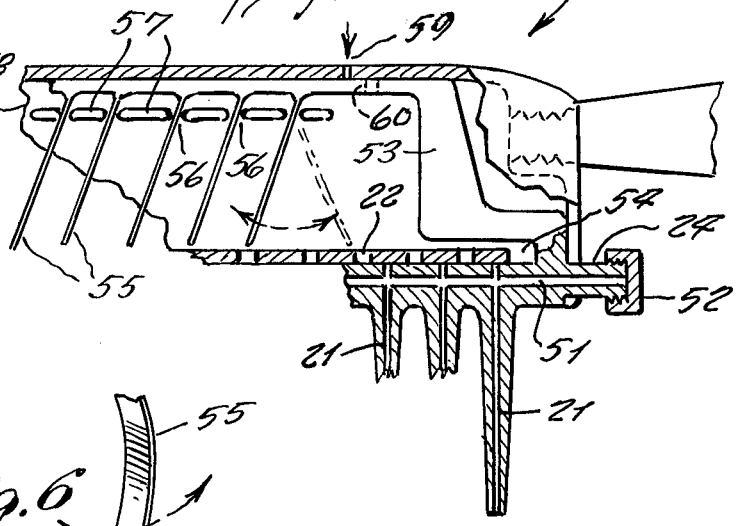

FIG. 5 shows another modified design that includes an air bleed hole to allow air to enter the comb inner chamber as the medication flows out thus preventing vacuum build up and inability of medication free flow out the teeth openings; the device also including automatic agitators if residue forming type medication is used, and the device also including a clean out blow line to unclog stuffed teeth openings.

Figure 6:
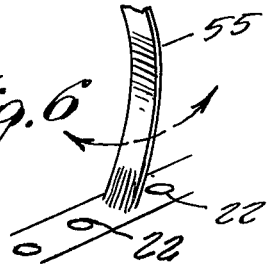

FIG. 6 shows one of the agitators of FIG. 5.

Figure 1:
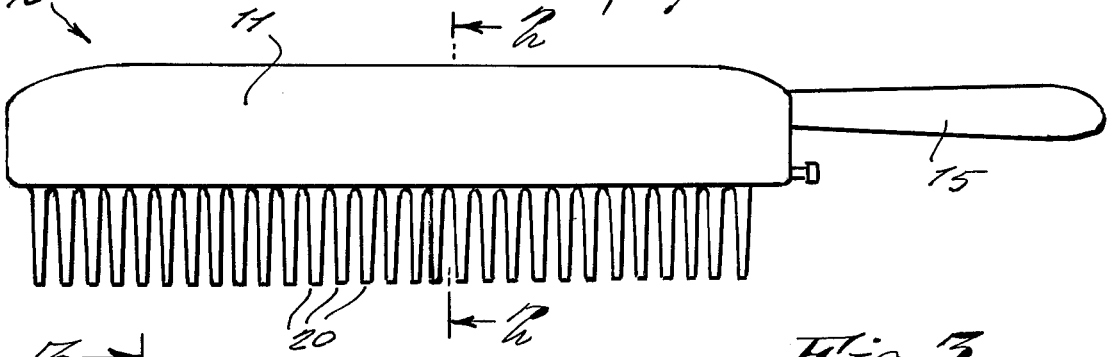
FIG. 1 is a side view of the invention.
Figure 2:
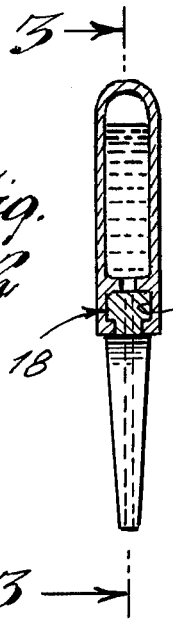
FIG. 2 is an enlarged cross sectional view taken on line 2—2 of FIG. 1.
Figure 3:
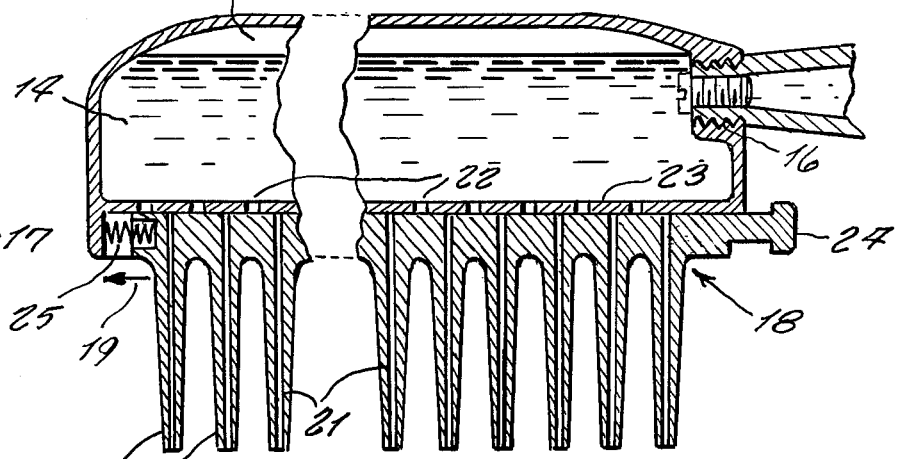
FIG. 3 is a cross sectional view taken on line 3—3 of FIG. 2.

Referring now to the drawing in greater detail, and more particularly to FIGS. 1 to 3 thereof at the present time, the reference numeral 10 represents a medicated comb according to the present invention wherein there is a flat comb backbone 11 from which a row of teeth 20 are integrally formed in a conventional shape. In the present invention, the backbone is hollow having a central chamber 13 for containing a liquid medication 14. A handle 15 at one end of the backbone, conventionally used for being held by the hand when combing the hair, serves in the present invention as a removable cap, that is screw threaded in the backbone as shown at 16 so to refill the chamber. As shown in FIG. 2, the handle can be hollow so to also contain an extra supply of the medication.

Adjacent a lower edge of the backbone there is a longitudinal slot 17 in which a teeth unit 18 is slidable a short distance as indicated by arrow 19. The teeth unit is molded in a single piece and includes the row of teeth 20 each one of which has a hollow opening 21 through its center so to align with openings 22 in a bottom wall 23 of the backbone when a push button projection 24 on one end of the teeth unit is pushed by a finger against a compression coil spring 25 located adjacent the opposite end of the unit in order to line up the openings 21 and 22 so that the medication can then flow out of the chamber 13 and out of the tip of the teeth upon the hair and scalp.

Thus in operative use the comb can be used in a conventional manner to comb the hair, and whenever medication application is wished, the push button projection is pushed so to release a small quantity of medication. When the push button is not depressed, it is apparent that the medication is sealed inside the comb so it cannot leak out.

Figure 4:
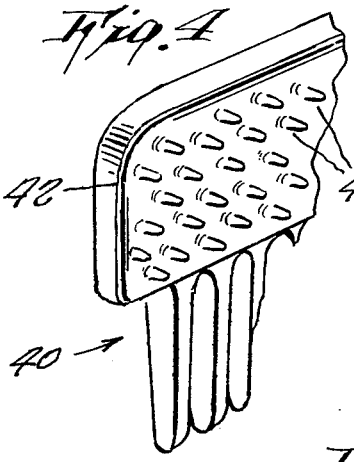
FIG. 4 is a fragmentary perspective view of a modified design of the invention which includes massaging prongs on a side of the comb backbone so the comb thus can also be used for massaging a scalp if turned on its side.

In FIG. 4 a slightly modified design of medicated comb 40 is the same as medicated comb 10 except that it additionally includes a series of sideward projections or fingers 41 on one side of the backbone in order to use as a scalp massager. The fingers may be made integrally molded with the backbone which is made of hard plastic, or else they may be molded of a softer plastic or resilient rubber integral with a flat base 42 that is sealed to a side of the hard plastic backbone.

In FIGS. 5 and 6, another modified design of medicated comb 50 includes all the structure of medicated combs 10 or 40 and additionally includes an air bleed hole 51 extending from the push button projectiong to all the central openings of the teeth. A removable end cap 52 is screwed on the projection 24 so to permit a person to blow air into the hole 51 and thus blow out any medication sediment that may clog the openings 21 and 22 or blow out dandruff that may clog the top of the openings 21. Additionally, the teeth unit 52 of this design integrally includes an extension 53 that projects through a slot 54 in bottom wall 23 and into the interior chamber 13 where flexible fins 55 are integral with extension 53 extend through grooves 56 formed between bumps 57 molded on one side wall of the backbone side wall 58, so that as the teeth unit is slided a short distance, as above described, the lower ends of the fins sweep in a long stroke across the ends of openings 22 so to wipe away any sediment. The ends of the fins are slitted a short distance so to form a brush.

Vent hole 59 of the backbone aligns with hole 60 of the extension 53 when the push button projection is depressed so to allow flow of medication without build up of vacuum pressure.

Thus, different forms of the invention are indicated.

While various changes may be made in the detail construction, it is understood that such changes will be within the spirit and scope of the present invention as is defined by the appended claims.

What is claimed is:

1. In a fluid dispensing comb, a comb backbone having an interior chamber containing dispensing liquid, having a hollow handle removably mounted on one end of said backbone forming a filler cap for said chamber with a longitudinal groove along a lower wall of said backbone, in combination with a tooth unit mounted slidably in said groove for longitudinal motion, said tooth unit having a row of hollow teeth each having a central opening therethrough, a push button projection on one end of said tooth unit, a compression coil spring adjacent an opposite end of said tooth unit bearing against said backbone and unit, openings through said backbone lower bottom wall so as to align said teeth openings with said lower wall openings when said push button projection is pushed to longitudinally slide said tooth unit relative to said backbone, said spring normally retaining the said unit in a position wherein said openings are not aligned, wherein a side wall of said backbone has a set of sideward massaging fingers, wherein an extension is integral with said tooth unit and extends through a slot of said bottom wall into said chamber, a row of fins formed on said extension each extending between two bumps on a side wall of said backbone, an end of said fins being slitted to form brushes that brush across said openings of said backbone lower bottom wall.

2. The combination as set forth in claim 1 wherein said tooth unit includes a transverse hole between said teeth central openings and through a center of said push button projection, and a removable end cap screwed on said push button projection for closing an end of said hole.

* * * * *